US005412956A

United States Patent [19]

Levy

[11] Patent Number: 5,412,956

[45] Date of Patent: May 9, 1995

[54] VARIABLE SIZED HINGED RING

[75] Inventor: Davida Levy, Surfside, Fla.

[73] Assignee: Davida Enterprises, Inc., Miami, Fla.

[21] Appl. No.: 183,380

[22] Filed: Jan. 19, 1994

[51] Int. Cl.[6] ..... A44C 9/02

[52] U.S. Cl. ..... 63/15.65

[58] Field of Search ..... 63/15.45, 15.5, 15.65

[56] References Cited

U.S. PATENT DOCUMENTS

| | | | |
|---|---|---|---|
| 1,997,723 | 4/1935 | Franklin, Jr. | 63/15.5 |
| 1,997,724 | 4/1935 | Franklin, Jr. | 63/15.65 |
| 3,221,514 | 2/1964 | Newman . | |
| 3,423,956 | 6/1967 | Manne . | |
| 3,736,770 | 6/1973 | Kelrick . | |
| 3,890,801 | 6/1975 | Newman . | |
| 4,592,211 | 6/1986 | Ross . | |

FOREIGN PATENT DOCUMENTS

| | | | |
|---|---|---|---|
| 264679 | 1/1927 | United Kingdom | 63/15.45 |

*Primary Examiner*—3
*Assistant Examiner*—Michael J. Milano
*Attorney, Agent, or Firm*—Keck, Mahin & Cate

[57] ABSTRACT

A variable sized finger ring has a center shank member and first and second side shank members. Each side shank member is hinged at a first end portion to a respective end of the center shank member and a second end portion of each side shank member is hollow. An elongated sizing section extends in the hollow second end portions of the side shank members. The sizing section has a plurality of stops thereon for determining the circumferential size of the ring. A first end of the sizing section is secured within the hollow second end portion of the first side shank member and a second end of the sizing section is retained within the hollow second end portion of the second side shank member. The sizing section is movable to locate one of the plurality of stops in position against a fixed part of the hollow second end portion of the second side shank member, thus fixing the circumferential size of the ring. The ring is adjustable in size between a fully closed position, a fully open position and at least one intermediate position.

7 Claims, 3 Drawing Sheets

VARIABLE SIZED HINGED RING

FIELD OF THE INVENTION

The invention relates to a variable sized hinged ring suitable for wearing on any selected finger of a hand or for putting on over an enlarged finger joint.

BACKGROUND OF THE INVENTION

Hinged rings of the prior art, having hinges on both sides of the shank, each have disadvantages of ease of use and practicability.

Ross, U.S. Pat. No. 4,592,211, describes a ring hinged on each side which may be pulled open to a single larger position. One side of the ring may be pulled out until a stop is reached. The ring can then be pushed into the closed position for wear. The ring is not intended for wearing in the opened position, but is intended to pass easily over an enlarged finger joint, and then be closed for wear.

Newman, U.S. Pat. No. 3,890,801, describes an opening ring which can be worn in an open or closed position. Ends of an inserted section engage frictionally inside the hollow shank portions of the ring. The ring cannot be fixed in any of the open positions and thus, if the frictional engagement becomes loose in wear, the ring may open to a larger size, inadvertently, and be lost.

Manne, U.S. Pat. No. 3,423,956, describes another ring having two hinged portions. The hinged portions include springs which bias the shank sections toward each other into a normal position where the sizing section establishes a minimum ring size. In a second embodiment, the springs at the hinges are eliminated and the insert member is fabricated of a springy metal. During movement relative to the surrounding member, the insert member is flexed so as to exert a spring bias against outward movement, preventing inadvertent expansion of the ring. This ring also cannot be set to a fixed size open position.

Kelrick, U.S. Pat. No. 3,736,770, describes an adjustable ring having hinged shank portions on each side and a latch piece secured to one of the portions having a tooth for engaging an aperture in a separate spring. The inner ends of the latch and spring are telescopically received in the second pivoted section and the inner end of the spring is fastened thereto by a pin. The latch may not be easy to manipulate. This patent is asserted to be an improvement over Newman, U.S. Pat. No. 3,221,514.

SUMMARY OF THE INVENTION

The purpose of the invention is to provide a variable sized finger ring for wearing in closed position or in one of a plurality of open positions to allow for wearing the ring on different fingers of a hand or to allow for putting on the ring over an enlarged finger joint. The ring has an interior sizing member which extends within hollow portions of the shank.

The variable sized finger ring has a center shank member and first and second side shank members. Each side shank member is hinged at a first end portion to a respective end of the center shank member and a second end portion of each side shank member is hollow. An elongated sizing section extends in the hollow second end portions of the side shank members. The sizing section has a plurality of stops thereon for determining the circumferential size of the ring. A first end of the sizing section is secured within the hollow second end portion of the first side shank member and a second end of the sizing section is retained within the hollow second end portion of the second side shank member. The stops extend outward from the sizing section and the sizing section is movable to locate one of the plurality of stops in position against a fixed part of the hollow second end portion of the second side shank member, thus fixing the circumferential size of the ring. The second side shank member may include at least one opening into which at least one of the stops extends when the ring is in a fixed position.

The ring may also include an open rectangular member 42 secured in the first side shank member, the open rectangular member has elongated side portions extending one on each side of the sizing section substantially parallel to the sizing section joined by first and second end portions. A first end portion is retained within the first side shank member and a second end portion is retained within the second side shank member. The second end portion may be spaced from the adjacent end of the sizing section. Alternatively the open member 42 may be a U-shaped member in which the first end portion is not joined to the remainder of the member but forms a separate support 32 within first side shank member 6 to which the U-shaped member may be fastened.

The sizing section may be made of a different metal from the metal of the open rectangular member. The ring is adjustable in size between a fully closed position, a fully open position and at least one intermediate position.

DETAILED DESCRIPTION OF THE PREFERRED EMBODIMENTS

A variable sized ring according to the invention is illustrated in FIGS. 1 to 7, in which like numerals represent like parts. The ring is illustrated as a plain ring but it may be enhanced with a jewelled portion, with engraving on at least a portion of the ring or otherwise as known in the art.

Figure 1:
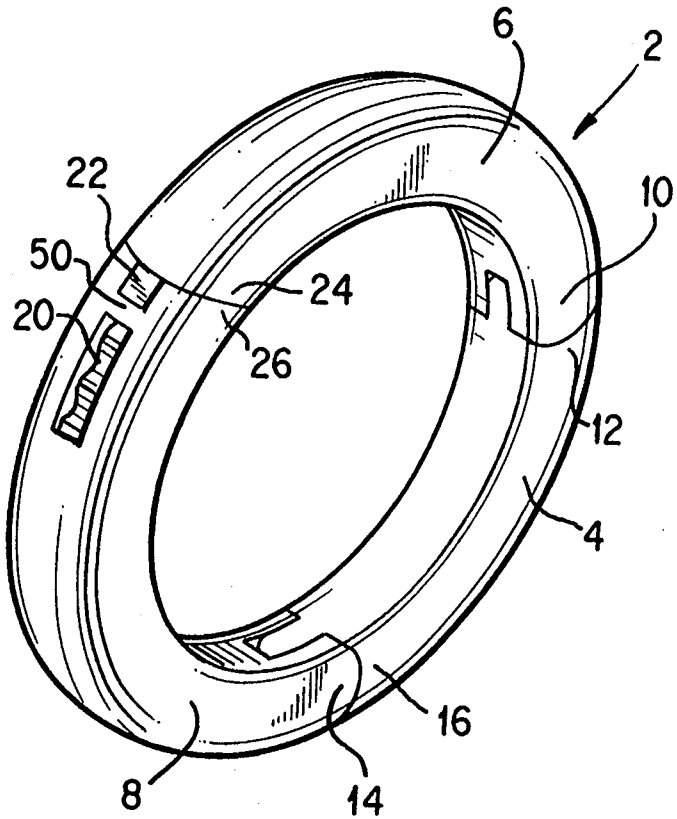
FIG. 1 is a perspective view of a variable sized hinged ring of the invention in closed position.
Figure 8:
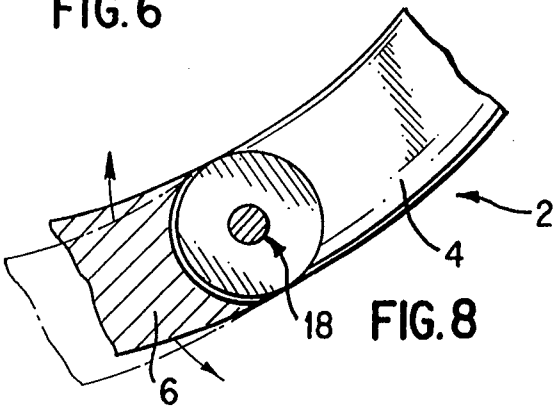
FIG. 8 is a partial cross-sectional view of a hinge portion of a ring, showing the open position in phantom.

FIG. 1 shows ring 2 according to the invention, having a center shank member 4 and two side shank members 6, 8 each hingedly attached to an end of center shank member 4 at a first end thereof. First end 10 of side shank member 6 is hingedly attached to end 12 of center shank member 4 and first end 14 of side shank member 8 is hingedly attached to end 16 of center shank member 4. A typical hinge 18 is illustrated in FIG. 8.

Figure 2:
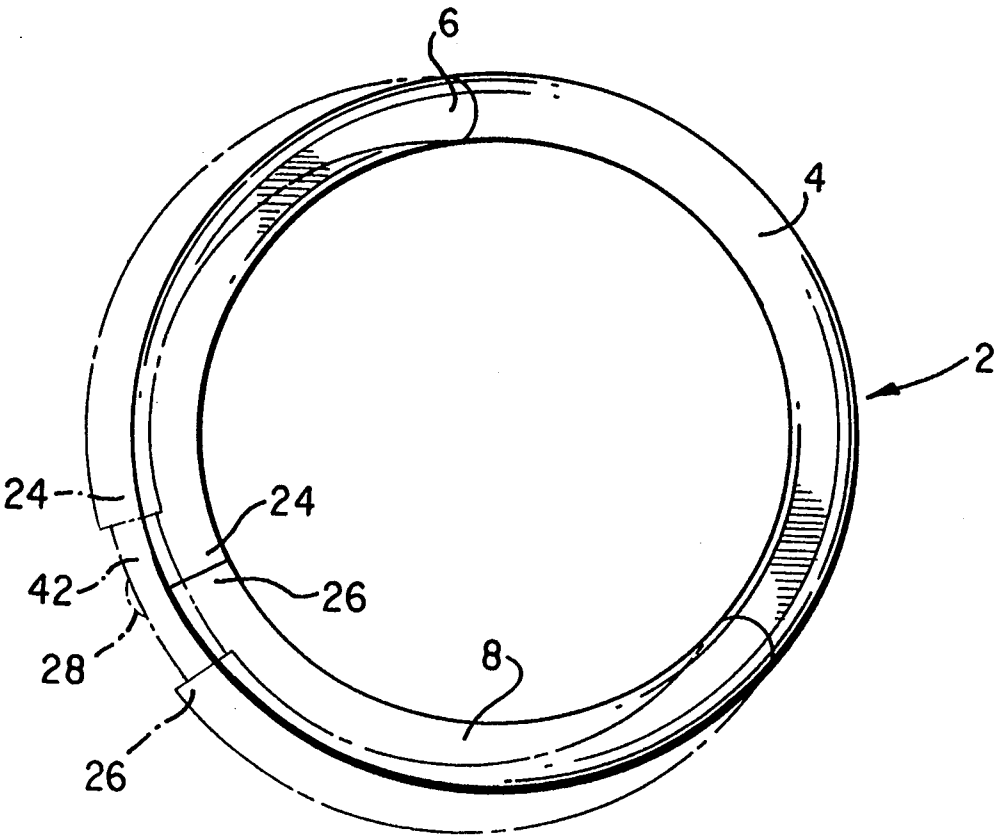
FIG. 2 is a side elevational view of the ring of FIG. 1 in fully open position, showing the closed position in phantom.

FIG. 1 shows openings 20, 22 in an outer surface of side shank member 8. Ring 2 opens by separation of side shank members 6 away from side shank member 8, as illustrated in FIG. 2. Ends 24, 26 of side shank members 6, 8, respectively, come together when the ring is closed and are separated when the ring is open. In FIG. 2, the phantom lines show the positions of side shank members 6, 8 when the ring is in an open position and open rectangular member 42 in which sizing section 28 is positioned can be seen extending between the side shank members 6, 8. Open rectangular member 42 is fixed to first side shank member 6 and moves through hollow end portion 26 of second side shank member 8 together with sizing section 28 which is positioned therewithin.

Figure 3:
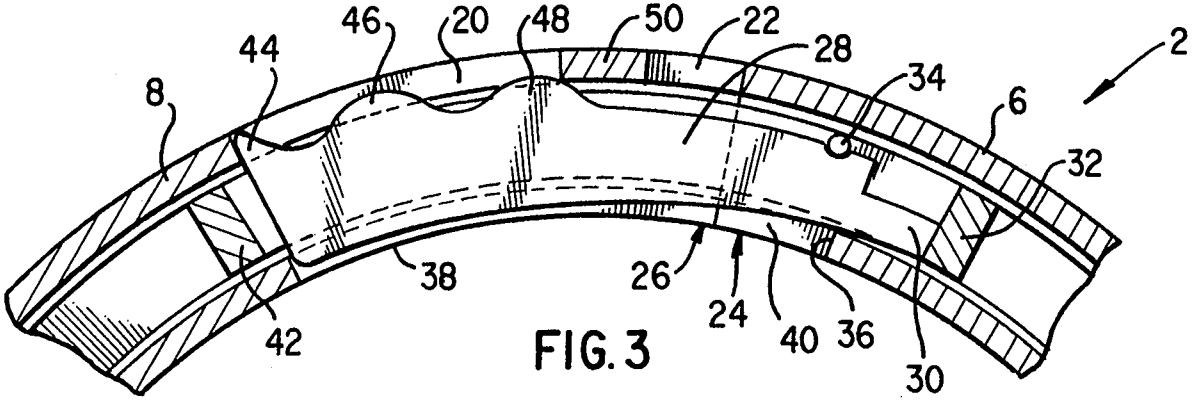
FIG. 3 is a cross-sectional view showing the closure portion of the ring in closed position.

FIG. 3 illustrates a cross-sectional view of the ring in closed position with ends 24, 26 of side shank members 6, 8 closed adjacent each other. Sizing section 28 is enclosed within side shank members 6, 8. Sizing section 28 is held at end 30 against strut 32 which extends through the depth of side shank member 6. Rivet 34 fastened across side shank member 6 holds sizing section 28 in position and allows sizing section 28 to pivot as necessary. Sizing section 28 moves against edge 36 of first side shank member 6. Ends 24, 26 of side shank members, 6, 8 are open to form a slit 38, 40 on the inside of ring 2, for allowing movement of rectangular member 42 and sizing section 28. Rectangular member 42 is fastened in first side shank member 6 and slides in second side shank member 8, thus protecting sizing section 28 positioned therewithin.

Figure 4:
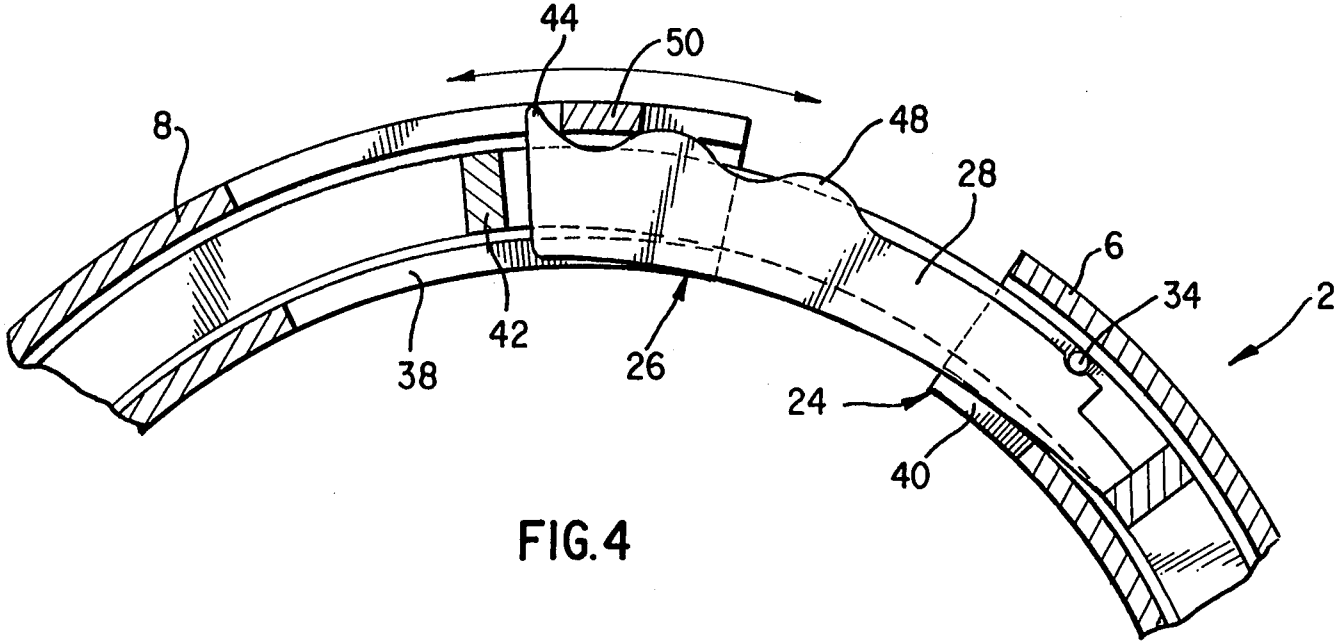
FIG. 4 is a cross-sectional view showing the closure portion of the ring in fully open position.
Figure 5:
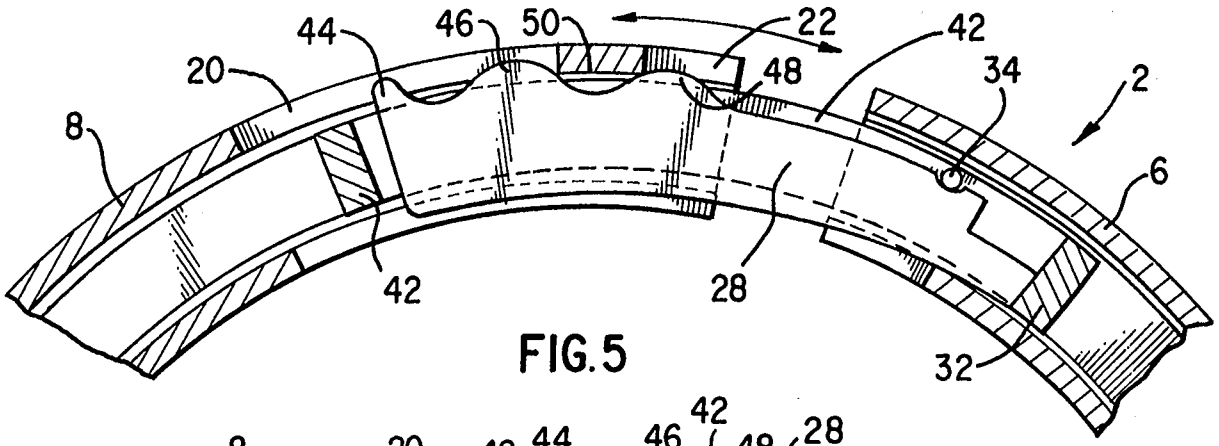
FIG. 5 is a cross-sectional view showing the closure portion of the ring in an intermediate open position.

FIG. 3 shows ring 2 in fully closed position. FIG. 4 shows ring 2 in fully open position and FIG. 5 shows ring 2 in partially open position. FIGS. 4 and 5 show the movement of side shank member 8 in the directions, shown by the double headed arrow.

In the closed position shown in FIG. 3, end 44 of sizing section 28 is adjacent the end of opening 20, and stop 50 rests against portion 48. In the fully open position shown in FIG. 4, stop 50 rests against end 44 of sizing section 28 in the furthest extended position. In the intermediate open position shown in FIG. 5, stop 50 rests against portion 46 of sizing section 28. Shaped portions 44, 46 and 48 are of such a size and shape that the ring is extended by pulling sides 6 and 8 apart from each other to allow stop 50 to rest against any of shaped portions 44, 46, 48, as required. The ring may be opened and closed readily, but will not open accidentally. The opening and closing of the ring is determined by the shape of portions 44, 46 48 which fit into openings 20, 22 as appropriate.

Figure 6:
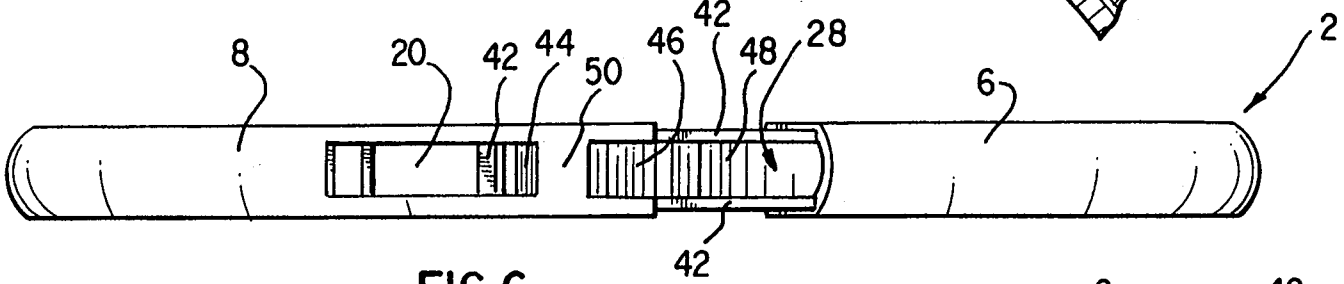
FIG. 6 is a top plan view of the closure portion shown in FIG. 5.
Figure 7:
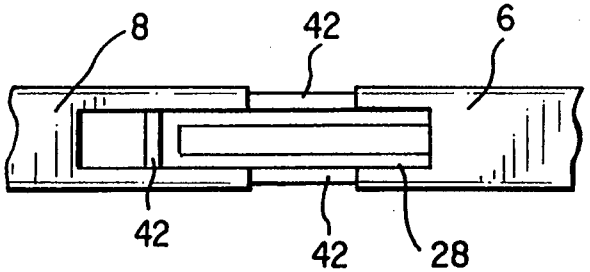
FIG. 7 is a fragmentary bottom plan view of the closure portion shown in FIG. 5.

FIG. 6 illustrates a top view of the ring in open position, showing stop 50 resting against shaped portion 44, allowing the ring to be extended to its widest open portion. Rectangular member 42 can be seen extending within side shank members 6, 8 on each side of sizing section 28. FIG. 7 illustrates a bottom view of the position of FIG. 6 in which it is seen how sizing section 28 is held within the rectangular member 42.

FIG. 8 shows a hinge portion of the ring in which center shank member 4 is hinged at 18 to side shank member 6. The movement of side shank member 6 is shown in phantom and indicated by the arrows.

Sizing section 28 allows ring 2 to be open at three different sizes, as illustrated. For example, ring 2 can fit fingers having ring sizes 5–6–7 or ring sizes 7–8–9 or otherwise as will be apparent to one skilled in the art. Thus, the ring is useful for putting on over a swollen finger joint in the open position and then closing for wear. Also, as different fingers of a hand are of different sizes, or fingers may change in size, the wearer can choose on which finger of a hand the ring will be worn. The ring provides the wearer with flexibility and choices of finger on which the ring may be worn.

The ring may be made of platinum, gold, silver or base metal, alone or in combination. Other materials will be apparent to those skilled in the art. Sizing section 28 and/or other parts may be made of a different metal from the rectangular member or from the remainder of the ring.

The ring may be plain or decorated in any desired way, within the scope of the invention. For example, the center shank member may include a jeweled portion, as is known in the art. The variable sized ring is simple and economical to manufacture and reliable in use.

While the invention has been described above with respect to certain embodiments thereof, it will be apparent to those skilled in the art that variations and modifications may be made without departing from the spirit and scope of the invention.

What is claimed is:

1. An adjustable finger ring comprising:

a center shank member;

first and second side shank members, each side shank member being hinged at a first end portion thereof to a respective end of the center shank member and a second end portion thereof being hollow; and an elongated sizing section having a plurality of stops thereon, said sizing section comprising a first end secured within said hollow second end portion of said first side shank member and a second end with said stops thereon continuously retained within said hollow second end portion by a fixed part of said second side shank member, said sizing section being movable to locate one of said plurality of stops in position against said fixed part of said hollow second end portion of said second side shank member, whereby the circumferential size of the ring is determined.

2. An adjustable finger ring according to claim 1 which is adjustable in size between a fully closed position, a fully open position and at least one intermediate position.

3. An adjustable finger ring according to claim 1 wherein said stops are spaced from each other and extend outward from the sizing section.

4. An adjustable finger ring according to claim 1 wherein said second side shank member includes at least one opening into which at least one of said stops extends.

5. An adjustable finger ring according to claim 1 wherein said first end of said sizing section is secured within said hollow second end portion of said first side shank member by a rivet fastened across said hollow second end portion.

6. An adjustable finger ring according to claim 1 further comprising a member secured in said first side shank member, said member comprising portions extending one on each side of the length of said sizing section, substantially parallel to said sizing section, and an end portion retained within said second side shank member.

7. An adjustable finger ring according to claim 6 wherein said end portion of said member is spaced from an end of said sizing section.

* * * * *